US007810218B2

(12) United States Patent
Dilo et al.

(10) Patent No.: US 7,810,218 B2
(45) Date of Patent: Oct. 12, 2010

(54) CROSS LAPPER

(75) Inventors: Johann P. Dilo, Eberbach (DE); Joachim Leger, Eberbach (DE)

(73) Assignee: Oskar Dilo Maschinenfabrik KG (DE)

( * ) Notice: Subject to any disclaimer, the term of this patent is extended or adjusted under 35 U.S.C. 154(b) by 946 days.

(21) Appl. No.: 11/651,898

(22) Filed: Jan. 10, 2007

(65) Prior Publication Data

US 2007/0175000 A1 Aug. 2, 2007

(30) Foreign Application Priority Data

Feb. 1, 2006 (EP) ..... 06002075

(51) Int. Cl.
*D01G 25/00* (2006.01)

(52) U.S. Cl. ..... 19/163

(58) Field of Classification Search ..... 10/163, 10/296, 300, 302, 98, 100
See application file for complete search history.

(56) References Cited

U.S. PATENT DOCUMENTS

| | | | | |
|---|---|---|---|---|
| 3,877,628 | A | 4/1975 | Asselin et al. | |
| 4,308,640 | A * | 1/1982 | Bulla et al. | 19/163 |
| 5,353,477 | A | 10/1994 | Hille et al. | |
| 6,189,185 | B1 * | 2/2001 | Bioul et al. | 19/163 |
| 6,195,844 | B1 | 3/2001 | Jourde et al. | |

FOREIGN PATENT DOCUMENTS

| | | | |
|---|---|---|---|
| DE | 26 09 396 | A1 | 9/1977 |
| DE | 43 04 988 | C1 | 4/1994 |
| EP | 0 517 563 | B2 | 10/1995 |
| EP | 0 517 568 | B1 | 10/1995 |
| EP | 0 659 220 | B1 | 12/1997 |
| EP | 0 860 531 | A | 8/1998 |
| EP | 0 865 521 | A | 9/1998 |
| EP | 1 010 786 | B1 | 9/2003 |
| WO | WO 2004/013390 | A1 | 2/2004 |

* cited by examiner

*Primary Examiner*—Tejash Patel
(74) *Attorney, Agent, or Firm*—Jansson Shupe & Munger Ltd

(57) ABSTRACT

A cross lapper for laying a fleece from a card web includes a laying carriage movable transversely with respect to an output conveyor belt above same, and an upper carriage as well as a plurality of card web transport belts for passing the card web through the upper carriage and the laying carriage into an output nip formed at the laying carriage, wherein a belt entrance with a downwardly inclined entrance zone is formed at the upper carriage through which a first card web transport belt is passed, which extends from a lower end of the entrance zone in the direction towards the laying carriage, and is accompanied in parallel in this section by a section of a second card web transport belt enclosing the card web together with this belt up to the laying carriage. The second card web transport belt leaving the laying carriage and guided back to same extends through a tensioning carriage only which is movable transversely with respect to the output conveyor belt, but is not passed through the upper carriage.

19 Claims, 4 Drawing Sheets

FIG. 4a
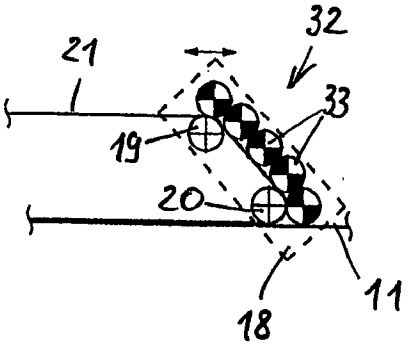
FIG 4b
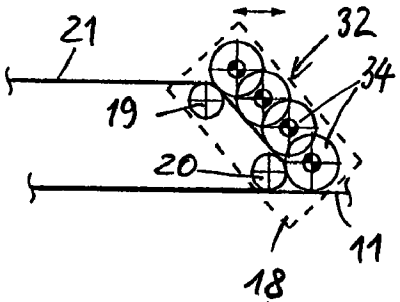
FIG. 4c
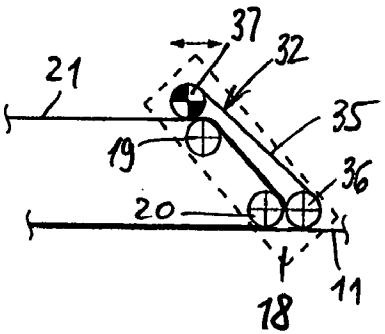
FIG. 4d
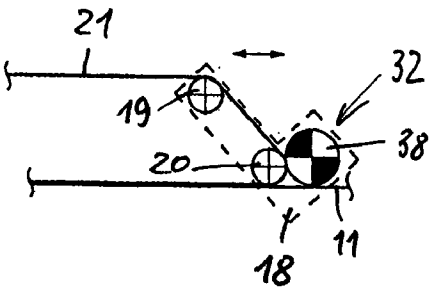
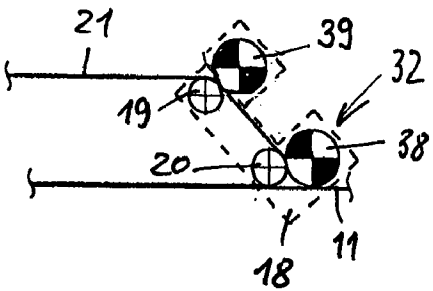
Fig. 4e

CROSS LAPPER

CROSS REFERENCE TO RELATED APPLICATION

This application claims priority to European patent application EP 06 002 075.7, filed Feb. 1, 2006.

FIELD OF THE INVENTION

The present invention refers to a cross lapper for laying a fleece from a card web.

BACKGROUND

In cross lappers having an upper carriage and a lower carriage, called laying carriage, through which endless card web transport belts are passed to transport a card web to be cross-layered onto an output conveyor belt to form a fleece, the course of the card web transport belts is rather complicated.

From EP 0 865 521 B1, a cross lapper is known, comprising a laying carriage movable on rails in a machine stand transversely with respect to an output conveyor belt above same, and an upper carriage as well as a plurality of card web transport and laying belts for transporting the card web via the upper carriage and the laying carriage into a discharge nip formed at the laying carriage for depositing the card web on an output conveyor belt. A card web receiving section comprises a belt entrance of the transport and laying belts (hereinafter referred to as the card web transport belts), having a downwardly inclined entrance zone with two adjacently extending belt sections of the card web transport belts. The belt sections joined at the entry of the belt entrance form a narrow entrance nip which is adapted to the card web thickness, and they extend in the entrance path substantially in parallel or at an acute angle with respect to one another and so close to one another that they guide or cover the card web in the entrance path on both sides. In this cross lapper, the two card web transport belts are passed through the upper carriage and the laying carriage.

U.S. Pat. No. 6,195,844 B1, EP 0 517 563 B2, U.S. Pat. No. 3,877,628, EP 0 517 568 B1, WO 2004/013390 A1, EP 0 659 220 B1 and EP 1 010 786 B1 show cross lappers in which both belts transporting the card web into the discharge nip at the laying carriage and onto the output conveyor belt are passed through the upper carriage and the laying carriage. The above-mentioned documents are only a selection among a great variety of documents which show cross lappers of identical belt course.

As already mentioned, the known constructions have a relatively complex course of their card web transport belts, particularly on the upper carriage where one of said belts supporting the card web loops by more than 90° around a deflection roller delimiting the entrance zone at its lower end. The arrangement becomes additionally complex in that the second card web transport belt is also passed through the upper carriage, in the structure according to EP 0 865 521 B1 even in a manner that it accompanies the first card web transport belt at a small distance within the area of the downwardly inclined entrance zone.

Thus, it is an object of the invention to provide a cross lapper that has a more simple but still reliable guidance of the belts participating in the card web transport and card web deposition.

SUMMARY OF THE INVENTION

To solve this object, the invention provides a cross lapper for laying a fleece from a card web, said cross lapper including a laying carriage movable transversely to an output conveyor belt above same and an upper carriage as well as a plurality of card web transport belts for guiding the card web through the upper carriage and the laying carriage into a discharge nip formed at the laying carriage, wherein a belt entrance with a downwardly inclined entrance zone is formed at the upper carriage, through which a first card web transport belt is passed, which extends from a lower end of the entrance zone in the direction towards the laying carriage, and is accompanied in parallel in this section by a section of a second card web transport belt enclosing the card web together with same up to the laying carriage, and is guided back through the laying carriage as a cover belt over the output conveyor belt and in parallel thereto towards the laying carriage, wherein the section of the second card web transport belt guided back to the laying carriage is passed through a tensioning carriage only which is movable transversely with respect to the output conveyor belt, said second card web transport belt being not passed through the upper carriage but is bypassing same.

In an alternative, the invention provides a cross lapper for laying a fleece from a card web, said cross lapper including a laying carriage movable transversely with respect to an output conveyor belt above same and an upper carriage as well as two card web transport belts for guiding the card web through the upper carriage and the laying carriage into a discharge nip formed at the laying carriage, wherein a belt entrance with a downwardly inclined entrance zone is formed at the upper carriage, and a first card web transport belt extending over the upper carriage is guided back through the laying carriage and transversely over the output conveyor belt and through a tension carriage to the belt entrance, and a second card web transport belt is passed through the laying carriage, said second card web transport belt having an upper part extending in parallel and at a close distance to the section of the first card web transport belt extending from the lower end of the entrance zone in the direction towards the laying carriage, said second card web transport belt further comprising a lower part extending in the same plane as the section of the first card web transport belt leaving the laying carriage, wherein the section of the second card web transport belt returning from the laying carriage in the direction towards the lower end of the entrance zone is passed only through a tensioning carriage movable transversely with respect to the output conveyor belt, said second card web transport belt being not passed through the upper carriage, but is bypassing same.

The solutions of the object on which the present invention is based are in particular and congruently characterized in that only one of each card web transport belts, in this case a first card web transport belt, is passed through the upper carriage which transports the card web to the deposition nip above the output conveyor belt. The other card web transport belt, in this case a second card web transport belt, however, passes below the upper carriage past same, but together with the first card web transport belt still encloses the card web in a sandwich-type manner on the way from the upper carriage to the laying carriage. In this manner the belt guidance within the cross lapper is significantly simplified. It has turned out that also in the case of high infeed speeds of the card web, an inadmissible fiber flight does not occur at the upper carriage, since on the one hand the deflection of the fibers lying on the first card web transport belt takes place at the upper deflection roller of the upper carriage at an obtuse angle and thus the deflection of the card web on its way into the downwardly inclined entrance zone is moderated, and on the other hand the card web is enclosed in a sandwich-type manner by two belts directly after its deflection at the lower deflection roller of the upper carriage in the above-mentioned manner.

If in the case of extremely high card web transport speeds the entrance into the downwardly inclined entrance zone on the upper carriage causes difficulty, according to an advantageous development of the invention a guide means may be provided there, which opposes the downwardly inclined section of the first card web transport belt and which forms an entrance nip with same. According to a first variant, the guide means may be composed of a series of closely spaced rollers, which are driven preferably by a motor individually or as a group, however may alternatively be driven by the deflection rollers by a mechanical coupling with the deflection rollers of the upper carriage. According to a second variant, the rollers are possibly driven disk rollers the disks of same mesh with one another in view of an axial offset and respective axial close spacing of the rollers. In a third variant the guide device is composed of a belt endlessly revolving within the upper carriage and connected with an independent drive. According to a fourth variant the guide means consists of a driven roller opposing the lower deflection roller of the upper carriage, and according to a fifth variant of two driven rollers, which oppose the upper and lower deflection rollers in the upper carriage at a close distance. In an especially simple variant, the guide means is a smooth guide plate opposing the first card web transport belt. To avoid air cushions around the card web, in the third variant, the guide belt endlessly revolving within the upper carriage may in a preferred embodiment be formed as a perforated belt. In the variant including rollers, the rollers of the guide means may be perforated rollers. When using disk rollers, these rollers inherently offer the desired air venting.

According to a further advantageous variant, the first card web transport belt may be a perforated belt. The discharge or venting of air from the web when pressing the web onto the first card web transport belt is enhanced thereby. This construction is especially useful for the first embodiment of the invention, since in this construction only the first card web transport belt takes over the transport function but is not at the same time a cover belt, since the cover belt should possibly be smooth. The design of this card web transport belt as a perforated belt enables in a simple manner to exert a controlled stretching function with the cross lapper. Details will be explained later.

According to an advantageous development of the invention a suction means may be arranged within the upper carriage on the side opposing the card web supporting surface of the perforated belt, said suction means producing a vacuum at the perforated belt, which helps holding the card web on the filter belt. The first card web transport belt as well as the endless belt revolving within the upper carriage may be formed as perforated belts. The combination of a perforated belt as first card web transport belt and perforated rollers within the upper carriage is also possible.

The basic variants of the invention comprised by the common inventive idea differ from one another in that in the first variant the first card web transport belt passes through the upper carriage only, but not also through the laying carriage. The second card web transport web, which supports the card web on its way between the upper carriage and the laying carriage in a horizontal section and guides it into the discharge nip, beyond the discharge nip takes over a cover function for the fleece deposited on the output transport belt. This belt section is returned to the laying carriage beyond the output conveyor belt over a tension carriage guided movably transversely with respect to the output conveyor belt. A second belt may be passed through the laying carriage, said second belt taking over a cover function on the side of the laying carriage opposing the second card web transport belt. The lower part of this separate cover belt lies approximately on the same height as the section of the second card web transport belt leaving the laying carriage. The separate cover belt is guided to a tension roller and back to the laying carriage, wherein this tension roller may be arranged in the same tension carriage as the tension roller of the second card web transport belt, since the translatory instant movements of the two tension rollers are synchronous with respect to one another during operation of the cross lapper. This tension carriage is preferably arranged below the output conveyor belt for saving space, and thus moves in a direction opposite to the movement of the laying carriage. The cover belts are preferably smooth in order not to interfere with the laid fleece upon contact with same.

In the other variant, the first card web transport belt is not passed not only through the upper carriage but also through the laying carriage, comparable to what is described in the mentioned prior art. This saves a separate cover belt for the section of the output conveyor belt arranged on the side of the laying carriage opposing the second card web transport belt. A cross lapper of this type therefore has two revolving belts only, wherein only one of which is passed through the upper carriage. For the second card web transport belt, an independent tensioning carriage is provided, which is different to the tensioning carriage of the first card web transport belt, since the movement speeds of the two tensioning carriages are different because of the different kinematics of upper carriage and laying carriage, so that they cannot directly be coupled with one another. In this variant, the two card web transport belts are preferably smooth.

In the last mentioned variant, the first card web transport belt may be passed through the laying carriage together with the second card web transport belt up to the discharge nip above the output conveyor web, provided that the friction between the belts and the interposed card web is not harmful for the card web at the common deflection roller in the laying carriage. In cases where this is not acceptable, according to a preferred embodiment the first card web transport web may be passed in the upper carriage via further deflection rollers supported there, in order to separate it in front of the deposition nip from the card web, and to reunite with same directly before reaching the deposition nip, which is actually already described in the prior art.

The invention will now be described with reference to the embodiments shown in the drawings:

BRIEF DESCRIPTION OF THE DRAWINGS

FIGS. 4*a* to 4*e* show sections of schematic side elevation views of embodiments of the upper carriage of the invention that can be used with the above-mentioned embodiments.

DETAILED DESCRIPTION OF PREFERRED EMBODIMENTS

In the above-mentioned drawings only the parts essential for explaining the invention are shown in order not to overload the drawings with superfluous details. Particularly a machine frame and the rails on which the movable carriages are displaceably guided in the machine frame are not shown. A housing of the overall arrangement shown in dotted lines can be seen only.

Figure 1:
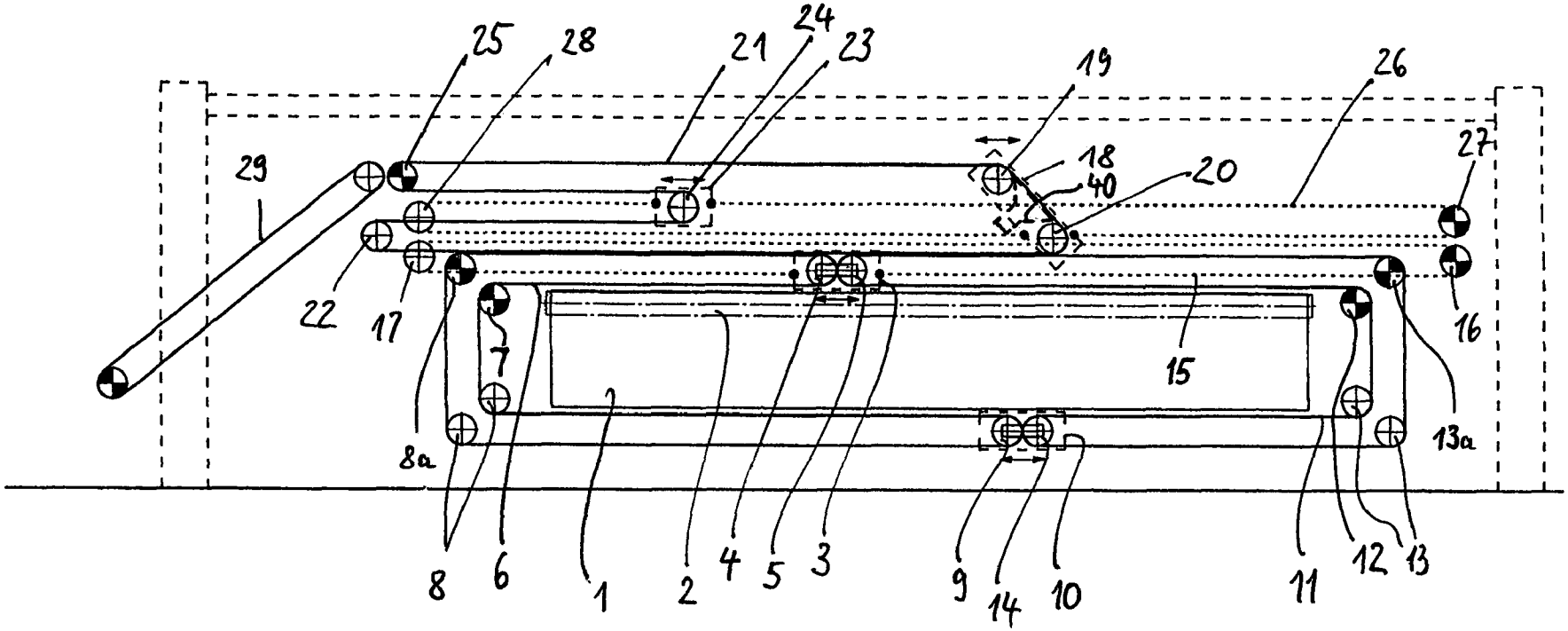
FIG. 1 shows a schematic view of a first embodiment of the invention.

FIG. 1 shows a schematic view of a first embodiment of the invention in a front view with respect to the output conveyor belt. An endlessly revolving output conveyor belt 1 can be seen in FIG. 1 which is adapted to convey a laid fleece in a transport direction extending perpendicularly with respect to the drawing plane. Among the guide means of the output transport belt, an upper deflection roller 2 is shown in dot and dash lines. Above the output conveyor belt 1 a laying carriage 3 can be moved back and forth on rails (not shown). Two deflection rollers 4 and 5 are freely rotatably supported in the laying carriage 3. The first deflection roller 4 is partially looped by a first cover belt 6, which has a lower part, which extends at a close distance above the output conveyor belt 1 to a driven deflection roller 7, over a further stationary deflection roller 8 and to a deflection roller 9, which is rotatably supported in a first tensioning carriage 10, which is displaceable below the output conveyor belt 1 transversely with respect to the output conveyor belt on rails (not shown). From the deflection roller 9 supported in the tensioning carriage 10 said cover belt 6 runs over two also stationary deflection rollers 8 and 8*a* back to the laying carriage 3. The driven deflection roller 7 is coupled with a motor (not shown) and is adapted to drive the first cover belt 6 in different directions.

In a similar manner, the other deflection roller 5, which is rotatably supported in the laying carriage 3 is partially looped by a second cover belt 11, which is guided via a driven deflection roller 12 and a stationary deflection roller 13 to a second deflection roller 14 supported in the first tensioning carriage 10, said deflection roller 14 being partially looped by the cover belt 11, from where the cover belt 11 returns via further stationary deflection rollers 13 and 13*a* to the laying carriage 3. The second cover belt 11 has a lower part which extends at a close distance above the output conveyor belt 1. The driven deflection roller 12 is coupled with a motor (not shown) and is adapted to drive the second cover belt 11 in different directions.

A chain or toothed belt 15 is attached at the laying carriage 3, said chain or toothed belt 15 running over a drive gear 16 connected to a motor (not shown) and a deflection gear 17. By means of these drive means, the laying carriage 3 above the output transport belt 1 can be moved back and forth transversely to its transport direction.

In a position elevated with respect to the height level of the laying carriage 3 an upper carriage 18 is displaceably supported on rails (not shown) in the machine frame transversely with respect to the output conveyor belt 1. The upper carriage 18 has an upper deflection roller 19 and a lower deflection roller 20, which are laterally offset with respect to one another. A card web transport belt 21, hereinafter referred to as the first card web transport belt, extends over these two rollers 19 and 20. In the area delimited by the two deflection rollers 19 and 20 in the upper carriage 18, the first card web transport belt 21 extends downwardly inclined. Starting from the lower deflection roller 20 in the upper carriage 18, the first card web transport belt 21 extends in parallel to the upper part of the two cover belts 6 and 11. It is guided over a deflection roller 22 stationarily supported in the machine frame and from there via a deflection roller 24 supported in a second tensioning carriage 23 and from there to a stationarily supported motor-driven deflection roller 24, before it reaches the upper carriage 18 again. The upper carriage 18 and the second tensioning carriage 23 are connected to one another via a chain or a toothed belt 26, which extends over a drive gear 27 connected to a motor (not shown) and a deflection gear 28, which are supported in the machine frame. Furthermore, a transversely upwardly extending supply belt 29 can be seen in FIG. 1, which supplies a card web (not shown) to be laid to the first card web transport belt 21.

In the area between the lower deflection roller 20 of the upper carriage 18 and the second deflection roller 5 of the laying carriage 3 the first card web transport belt 21 and the second cover belt 11 are arranged in parallel at a close distance so that a card web supplied by the first card web transport belt 21 is enclosed in sandwich-type manner by the first card web transport belt 21 and the second transport belt 11 in said portion between the upper carriage and the laying carriage. The card web is supported by said cover belt 11, which is why the cover belt is also designated as second card web transport belt in the sense of the present invention.

In the example shown a schematically shown suction means 40 is provided which opposes the first web card transport belt 21 in the area of the entrance zone on the card web rest surface. During operation, a vacuum built up by the suction means 40 helps holding the card web on the first card web transport belt 21 if this belt is formed as a perforated belt. The use of a perforated belt as first card web transport belt 21 is particularly advantageous, since it is possible by its help to press the air out of the card web in the area between the upper carriage and the laying carriage where two belts are guided in parallel and enclose the card web in a sandwich-like manner between them without fibers of the card web being laterally blown out and the fiber orientation being disturbed by the air flowing off.

It can be seen in the drawing that during operation, when the laying carriage 3 performs a movement reciprocating above the output conveyor belt 1, the first tensioning carriage 10 carries out a movement in the opposite direction, since the loop lengths of the cover belts 6 and 11 are constant. Furthermore, the upper carriage 18 and its associated second tensioning carriage 23 perform a movement in the opposite direction during operation, since they are positively connected to one another by means of the chain or the toothed belt 26. The second tensioning carriage 23 is required to keep the loop length of the first card web transport belt 21 constant.

The kinematics of the upper carriage 18 and the laying carriage 3 completely corresponds to the kinematics described in EP 0 865 521 B1. The movements of the laying carriage 3 and the upper carriage 18 are adapted to one another such that when supplying the card web over the supply belt 29 at a regular speed, a controlled deposition of the card web onto the output conveyor belt 1 without stretching or upsetting the card web within the cross lapper taking place. The fact is also taken into consideration that the laying carriage 3 in the area of its movement reversal must be decelerated to its standstill and must be accelerated again in the opposite movement direction. If the card web is supplied at a fluctuating speed, for instance since a cyclically operating stretching unit is arranged upstream of the supply belt 29 and generates an alternating thickness in the card web for the purpose of obtaining a transverse profile of the fleece laid, a card web buffering within the cross lapper can be carried out by means of an independent control of movement of upper carriage 18 and laying carriage 3. In this case, a second buffering is superimposed on the buffering required for the compensation of the fluctuating laying carriage speed, said second buffering being required for the compensation of the fluctuating card web entrance speed. Depending on the adaptation of the timing of the stretching processes with the one of the laying carriage movement, these bufferings may possible be counter-phase to one another, i.e. they may mutually compensate each other fully or partially.

If according to the further embodiment of the invention the first card web transport belt 21 is formed as a perforated belt, an aimed stretching function can be exerted by the cross lapper. If among the deflection rollers of the cover belts 6 and 11 two deflection rollers are provided with independently controllable motor drives, which is expressed in FIG. 1 by the graphic illustration of the deflection rollers 7 and 8*a* as well as 12 and 13*a*, it can be achieved that the speed of the cover belts 6 and 11 can be made independent of the movement speed of the laying carriage 3.

Usually, the drives of the cover belts are controlled by means of the drive rollers 7 and 12 such that the cover belt lying backwards in the movement direction of the laying carriage 3 simply rests on the laid fleece and does not move with respect thereto, while the cover belt lying in front in the direction of movement of the laying carriage 3 moves forward at double speed with respect to the movement speed of the laying carriage 3. The circumferential speed of the deflection roller 5 in the laying carriage 3, around which the card web runs together with the cover belt 11 transporting the first card web transport belt, is as high as the speed between the laying carriage 3 and the first card web transport belt 21.

Since according to an advantageous development of the invention the cover belts 6 and 11 can be driven by two drive rollers each, the cover belts 6 and 11 may be provided with a speed independent of the movement speed of the laying carriage 3. It is provided that the speed of the upper part of the cover belt 21, which together with the first web card transport belt 21 encloses the card web in a sandwich-type manner on the way from the upper carriage 18 to the laying carriage 3, is higher than the speed of the first card web transport belt 21. If the pressure at which the belts 21 and 11 contact the card web in this area is adjusted appropriately, the cover belt 11, which is smooth, may slide along the card web, while the first card web transport belt 21 formed as a perforated belt, holds the card web due to its relatively rough surface structure. If the pressure acting on the card web in the discharge nip at the deflection rollers 4 and 5 is sufficiently high that a slip between the belts and the card web is excluded or is substantially excluded there, the card web is stretched at the mentioned speed conditions in the area of the quarter circle lying between the portion where the cover belt 11 leaves the first card web transport belt 21 and the discharge nip around the deflection roller 5. This stretching may be performed cyclically to provide the fleece to be laid with a predetermined cross-sectional profile, but it may also be performed continuously, e.g. to re-orientate fibers. To carry out this stretching process, only a suitable control means for the drive motors of the drive rollers 7, 8*a*, 12 and 13*a* is required.

It can very clearly be seen in FIG. 1 that among the cover belts 6 and 11 shown none of these belts is passed through the upper carriage 18. However, one of these cover belts, namely the cover belt 11 takes over a card web transport function in the area between the upper carriage 18 and the laying carriage 3, similar as in the prior art. The course of the belts of the cross lapper according to the invention is, however, significantly simplified compared to the prior art, which also facilitates exchange of these belts.

The cover belts 6 and 11 form a nip at the point at which they are deflected in the laying carriage 3 by their deflection rollers 4 and 5, said nip being referred to before as discharge nip. During operation of the cross lapper, the second cover belt 11 is driven such that its upper part follows the movement of the lower part of the first card web transport belt 21, since both belts enclose the card web on its way between the upper carriage 18 and the laying carriage 3. In order to avoid shear forces at the card web in the discharge nip caused by friction at the cover belts, which delimit the discharge nip, the first cover belt 6 is driven such that the circumferential speed of the first deflection roller 4 in the laying carriage 3 is as high as the circumferential speed of the second deflection roller 5 but has an opposed sense of rotation.

Figure 2:
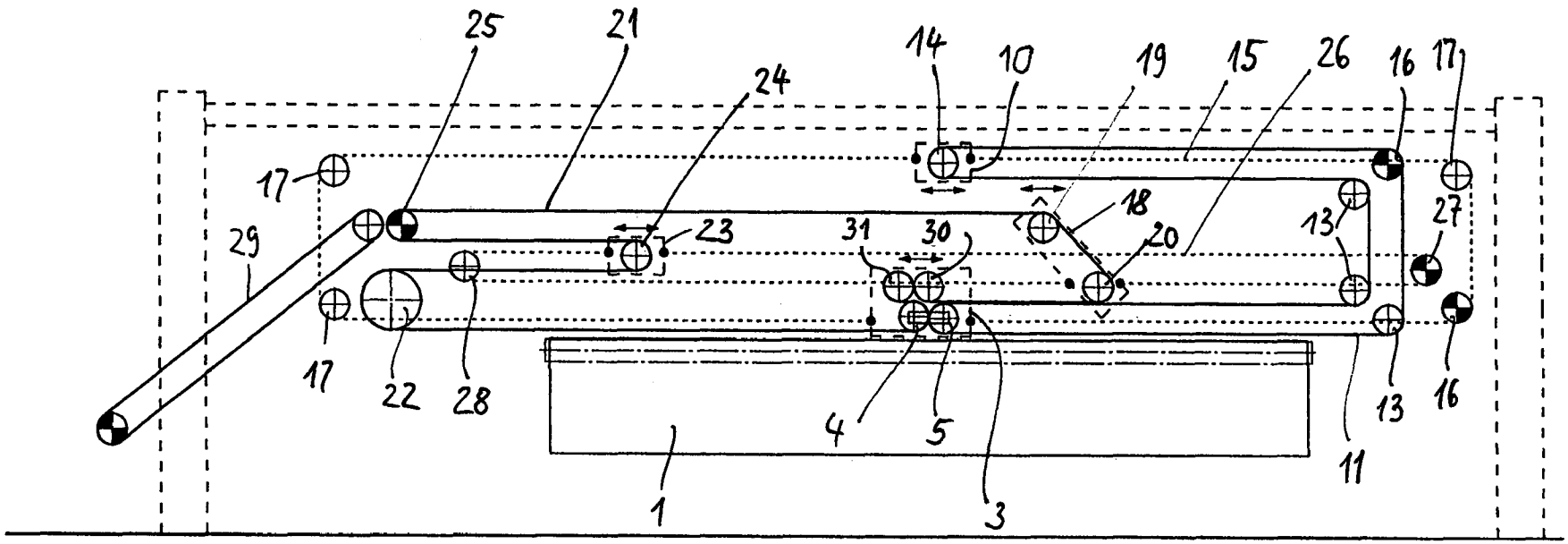
FIG. 2 shows a schematic view of a second embodiment of the invention.

FIG. 2 shows a second embodiment of the invention. While in the embodiment according to FIG. 1 a total of three belts participated in the card deposition and the card coverage, the embodiment according to FIG. 2 is characterized in that only two belts exist, which take over the card web transport function as well as the card web coverage function.

FIG. 2 shows the laying carriage 18 and its associated second tensioning carriage 23, which are coupled to one another by means of a chain or toothed belt 26, 27, 28. The first card web transport belt 21 is partially guided around the two deflection rollers 19 and 20 of the upper carriage 18 and extends through the laying carriage 3, where it partially loops a total of three deflection rollers 29, 30 and 31 in said sequence, to subsequently run back to the upper carriage 18 over a stationary deflection roller 22, the deflection roller 24 supported in the tensioning carriage 23 and the drive roller 25. On the way from the deflection roller 4 in the laying carriage 3 to the stationary deflection roller 22, the first card web transport web 21 extends at a close distance over the output conveyor belt 1 and forms a cover belt in this section.

The second cover belt 11 partially loops the second deflection roller 5 in the laying carriage 3, as already described by the example of FIG. 1. From the laying carriage 3 the lower part of the second cover belt 11 extends at a close distance over the output conveyor belt 1. It also runs over some stationary deflection rollers 13 and a stationary drive roller 16 and over the deflection roller 14 supported in the first tension carriage 10. The first tension carriage 10 and the laying carriage 3 are positively connected to one another in this example by a drive chain or a drive toothed belt 15, which runs over stationary deflection rollers 17 and a stationary drive roller 16 connected to a motor (not shown) and which is fastened at the laying carriage 3 as well as at the first tensioning carriage 10. In this example, only one deflection roller 14 for the second cover belt 11 is supported in the tensioning carriage 10.

In the area between the lower deflection roller 20 on the upper carriage 18 and the laying carriage 3, the first card web transport belt 21 and the upper part of the second cover belt 11 are guided in parallel and at a close distance so that the two belts clamp a card web supplied by the first card web transport belt 21 between them in this section. The second cover belt 11 in this area therefore takes over the function of a second card web transport belt.

When reaching the roller 5 deflecting the second cover belt 11 in the laying carriage 3, the first card web transport belt 21 and the second cover belt 11 separate from one another, since the first card web transport belt 21 is guided around two separate deflection rollers 29 and 30 to the deflection roller 4, which delimits the deposition nip, which is formed by said belts between the two deflection rollers 4 and 5 at the laying carriage 3. Through this actually known guide of the first card web transport belt 21, friction effects at the deflection roller 5 are avoided, which could be caused by different radii of the belts 21 and 11 participating in the deflection.

The remaining details of this embodiment shall not be described here to avoid repetitions. Reference is made to the respective reference numerals and their associated description in the first embodiment.

It can be seen from FIG. 2 that the course of the belts 11 and 21 participating in the card web transport and the card web coverage is very simple and that particularly the second cover belt/the second card web transport belt 11 taking over the card web transport between the upper carriage 18 and the laying carriage 3 is not passed through the upper carriage 18 but passes below this upper carriage 18.

The kinematics of the upper and laying carriages of this embodiment completely corresponds to the one according to FIG. 1 Thus, a repetition of the description is not necessary.

Figure 3:
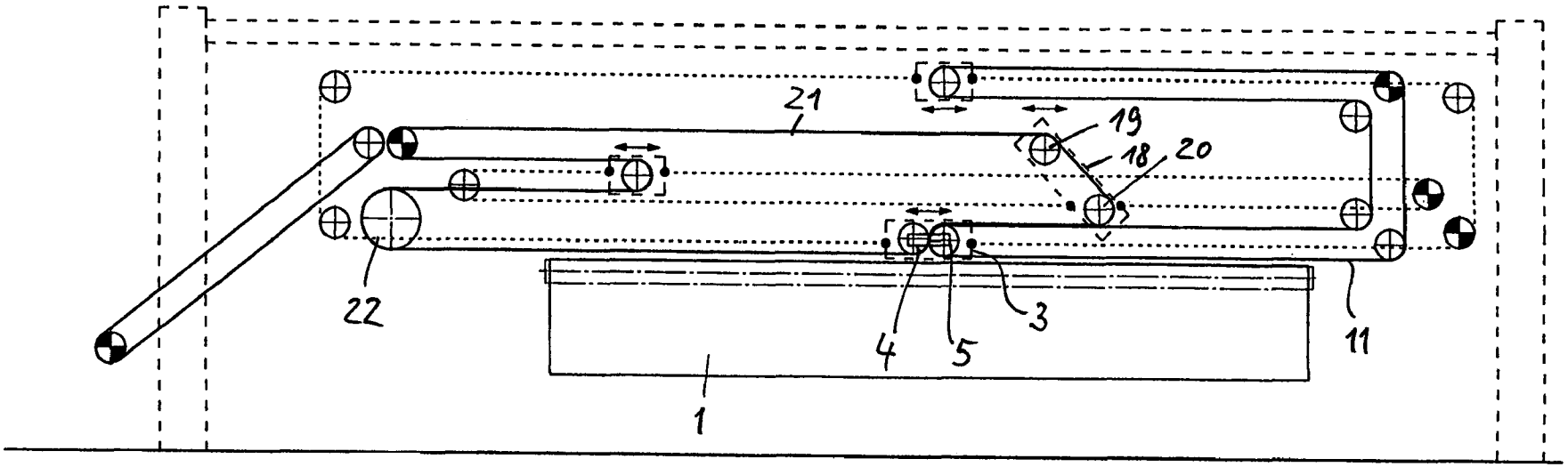
FIG. 3 shows a schematic view of a simplified variant of the second embodiment of the invention.

FIG. 3 shows a variant of the embodiment of FIG. 2. This variant differs from the one of FIG. 2 in that the first web transport belt 21 is guided within the laying carriage 3 only over the deflection rollers 5 and 4 supported there, wherein it wraps around both deflection rollers 5 and 4 each by 90° and therefore describes an S-shaped path in the laying carriage 3. The deflection over separate deflection rollers, as shown by 29 and 30 in FIG. 2, is dispensed with. Moreover, this embodiment of the invention corresponds to the one of FIG. 2. The course of the first card web transport belt 21 within the laying carriage 3 is extremely simple in this embodiment. This variant can be used, if friction effects resulting from unequally large radii of curvature of the belts 21 and 11 at the deflection roller 5 can be accepted.

FIGS. 4*a* to 4*e* show embodiments of the invention in the area of the laying carriage 18. The downwardly inclined entrance zone of the first card web transport belt 21 between the upper and the lower deflection rollers 19 and 20 within the upper carriage 18 can congruently be seen. In the area of this entrance zone downstream of the lower end of which the upper part of the second cover belt 11 rests against the first card web transport belt 21, a guide means 32 opposes the first card web transport belt 21, said guide means 32 extending across the entire inclined entrance zone in the embodiments of FIGS. 4*a* to 4*c*, and in the embodiment according to FIG. 4*d* is restricted to the portion around the lower deflection roller 20, and in the embodiment according to FIG. 4*e* is restricted to the portions around the upper and lower deflection rollers 19 and 20.

In the embodiment of FIG. 4*a*, the guide means 32 is composed of a plurality of rollers 33 arranged at a mutual distance with respect to one another, which oppose the first card web transport belt 21 at a close distance and in this manner clamp the card web (not shown) between same and the first card web transport belt 21. These rollers may be driven by a motor individually or as a group. However, they can also be driven by at least one of the deflection rollers 19 and 20 by means of mechanical coupling, since the deflection rollers 19 and 20 are set into rotation by the movement of the first card web transport belt 21 running over same.

In the embodiment of FIG. 4*b* the rollers are formed as disk rollers 34, which are axially set to nip and which are radially spaced apart so closely that the disks of the one roller engage into the nips between the disks of the other roller, i.e. they "mesh" as mentioned above, as schematically shown in FIG. 4*b*. The disk rollers 34 may be driven as the rollers 33 of the first variant according to FIG. 4*a* in order not to obstruct the infeed movement of the card web.

In the embodiment according to FIG. 4*c*, the guide means 32 is composed of an endless guide belt 35 revolving within the upper carriage 18 and looping a free running deflection roller 36 and a driven deflection roller 37. This guide belt 35 and its deflection rollers 36 and 37 are arranged at a close distance to the first card web transport belt 21 within the upper carriage 18 and thereby avoid any fiber flight in the upper carriage 18. The driven deflection roller 37 may have a motor drive or may be coupled mechanically with one of the deflection rollers of the first card web transport belt 21, as in the embodiment of FIG. 4*a*.

In the embodiment according to FIG. 4*d*, the guide means 32 is a compression roller 38, which has its own drive and which closely opposes the lower deflection roller 20 in the upper carriage 18. With this roller it forms an entrance nip for the card web, which prevents fiber flight in the area of the lower deflection roller 20.

In the embodiment according to FIG. 4*e*, the guide means 32 is formed by a lower compression roller 38, which has its own drive and which closely opposes the lower deflection roller 20 in the upper carriage 18, and by an upper compression roller 39, which closely opposes the upper deflection roller 19 in the upper carriage. Both compression rollers 38 and 39 prevent fiber flight in the area of the deflection rollers 19 and 20. The distance of the compression rollers to the deflection rollers may possibly be variable to be able to make an adaptation to the card web thickness.

It can be recognized that in this optional supplementation of the card web guide means according to FIGS. 4*a* to 4*e* the guide of the card web transport web is still simple.

While the principles of the invention have been shown and described in connection with specific embodiments, it is to be understood that such embodiments are by way of example and not limiting. Consequently, variations and modifications commensurate with the above teachings, and with the skill and knowledge of the relevant art, are within the scope of the present invention. The embodiments described herein are intended to illustrate best modes of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. A cross lapper for laying a fleece from a card web, said cross lapper including a laying carriage (3) movable on rails in a machine stand transversely to an output conveyor belt (1) above the output conveyor belt and an upper carriage (18) movable in the machine stand transversely to said output conveyor belt on rails as well, and a plurality of card web transport belts for guiding the card web through the upper carriage and the laying carriage into a discharge nip formed at the laying carriage, wherein a belt entrance with a downwardly inclined entrance zone is formed at the upper carriage, through which a first card web transport belt is passed, which extends from a lower end of the entrance zone in a section towards the laying carriage, and is accompanied in parallel in this section by a section of a second card web transport belt enclosing the card web together with the first card web transport belt until the laying carriage, the second card web transport belt being guided back through the laying carriage as a cover belt over the output conveyor belt and in parallel thereto towards the laying carriage, wherein a section of the second card web transport belt guided back to the laying carriage is passed through a tensioning carriage only which is movable transversely with respect to the output conveyor belt, said second card web transport belt bypassing said upper carriage (18).

2. The cross lapper as claimed in claim 1 comprising a second endless belt passed through the laying carriage and forming a second cover belt, said second cover belt together with the second card web transport belt forming the discharge nip within the laying carriage, said second cover belt being guided via stationary deflection rollers to a deflection roller supported in the tensioning carriage of the second card web transport belt and looping the deflection roller supported in the tensioning carriage of the second card web transport belt.

3. The cross lapper as claimed in claim 1 wherein the first card web transport belt is a perforated belt.

4. The cross lapper as claimed in claim 1 wherein in the belt entrance the first card web transport belt is opposed by a guiding device which is independent from the second card web transport belt and together with the first card web transport belt forms a card web entrance zone.

5. The cross lapper as claimed in claim 2 characterized in that the first card web transport belt is a perforated belt and the two belts acting as cover belts are each guided over two drive rollers coupled to individual motors.

6. A cross lapper for laying a fleece from a card web, said cross lapper including a laying carriage movable on rails in a machine stand transversely with respect to an output conveyor belt above the output conveyor belt and an upper carriage movable in the machine stand transversely to said output conveyor belt on rails as well, and two card web transport belts for guiding the card web through the upper carriage and the laying carriage into a discharge nip formed at the laying carriage, wherein a belt entrance with a downwardly inclined entrance zone is formed at the upper carriage, and a first card web transport belt extending over the upper carriage is guided through the laying carriage and transversely over the output conveyor belt and through a first tensioning carriage back to the belt entrance, and a second card web transport belt is passed through the laying carriage, said second card web transport belt having an upper part extending in parallel and at a close distance to a section of the first card web transport belt extending from a lower end of the belt entrance in a direction towards the laying carriage, said second card web transport belt further comprising a lower part extending in a same plane as a section of the first card web transport belt leaving the laying carriage, wherein a section of the second card web transport belt returning from the laying carriage in a direction towards the lower end of the belt entrance is passed through a second tensioning carriage only which is movable transversely with respect to the output conveyor belt, said second card web transport belt being not passed through the upper carriage but is bypassing same.

7. The cross lapper as claimed in claim 6 wherein the first card web transport belt is guided within the laying carriage in parallel to the second card web transport belt up to a discharge nip disposed above the output conveyor belt, where the two card web transport belts each loop around a respective deflection roller and separate from one another.

8. The cross lapper as claimed in claim 6 wherein in the belt entrance zone the first card web transport belt is opposed by a guiding device which is independent from the second card web transport belt and together with the first card web transport belt forms a card web entrance.

9. The cross lapper as claimed in claim 7 wherein the guiding device consists of a plurality of rollers disposed close to one another and to the first card web transport belt.

10. The cross lapper as claimed in claim 9 wherein the rollers composed of disks axially spaced from one another, the disks of two adjoining disk rollers being are axially mutually set to nip, a radial distance of said rollers being smaller than a disk diameter so that the disk rollers mutually penetrate one another.

11. The cross lapper as claimed in claim 8 wherein the guiding means is formed by a guide belt endlessly revolving within the upper carriage, said guide belt being guided in the upper carriage over two deflection rollers.

12. The cross lapper as claimed in claim 11 wherein one of the deflection rollers of the guide belt within said upper carriage is arranged above a deflection roller of the first card web transport belt, which deflection roller of the first card web transport belt delimits the entrance zone at an upper end of the entrance zone.

13. The cross lapper as claimed in claim 11 wherein the guide belt is a perforated belt.

14. The cross lapper as claimed in claim 12 wherein the guide belt is a perforated belt.

15. The cross lapper as claimed in claim 8 wherein the guiding device is formed by a compression roller which is arranged next to a deflection roller of the first card web transport belt delimiting a card web transport belt entrance zone within said upper carriage at a lower end on a same level as said deflection roller.

16. The cross lapper as claimed in claim 15 wherein the guiding device comprises a second compression roller arranged next to a deflection roller of the first card web transport belt delimiting a card web transport belt entrance zone within the upper carriage at an upper end approximately on a same level as said deflection roller.

17. The cross lapper as claimed in claim 8 wherein the guiding device is a sheet with a smooth surface opposing the first card web transport belt in a card web transport belt entrance zone within the upper carriage.

18. The cross lapper as claimed in claim 6 wherein the first card web transport belt is a perforated belt.

19. The cross lapper as claimed in claim 18 wherein a suction means is provided within the upper carriage in the area of the entrance zone on the side opposing the first card web transport belt.

* * * * *